US005651140A

United States Patent [19]

Gibson

[11] Patent Number: 5,651,140

[45] Date of Patent: Jul. 29, 1997

[54] NECK-PROTECTING GARMENT FOR SURGEONS AND OPERATING ROOM PERSONNEL

[76] Inventor: Timothy Patrick Gibson, R.R. 4, Box 56C, Oneonta, N.Y. 13820

[21] Appl. No.: 590,224

[22] Filed: Jan. 23, 1996

[51] Int. Cl.[6] ..... A41D 13/00

[52] U.S. Cl. ..... 2/46; 2/49.1; 2/51

[58] Field of Search ..... 2/49.1, 49.4, 50, 2/51, 46, 901, 114, 60, 463, 468, 174, 103, 457

[56] References Cited

U.S. PATENT DOCUMENTS

| | | | |
|---|---|---|---|
| 1,243,462 | 10/1917 | Troiano | 2/50 |
| 1,688,880 | 10/1928 | Pope et al. | 2/50 |
| 2,116,685 | 5/1938 | Nicolet | 2/50 |
| 2,282,183 | 5/1942 | Harris | 2/50 |
| 2,544,487 | 3/1951 | Caluthis | 2/50 |
| 2,851,690 | 9/1958 | Jennings | 2/50 |
| 2,987,730 | 6/1961 | Walker | 2/50 |
| 4,133,052 | 1/1979 | Hodgman et al. | 2/174 |
| 4,980,927 | 1/1991 | Wawiluk et al. | 2/60 |
| 5,079,777 | 1/1992 | Fowler et al. | 2/46 |
| 5,230,100 | 7/1993 | Lock-Jones | 2/50 |
| 5,469,580 | 11/1995 | Sobol | 2/49.4 |

FOREIGN PATENT DOCUMENTS

| | | | |
|---|---|---|---|
| 1019140 | 1/1953 | France | 2/49 R |
| 3341383 | 5/1985 | Germany | 2/49.1 |
| 603350 | 6/1948 | United Kingdom | 2/50 |

*Primary Examiner*—Amy B. Vanatta

*Attorney, Agent, or Firm*—Salzman & Levy

[57] ABSTRACT

A blood-repellent neck protector for hospital, surgical, and emergency room personnel is featured. The protector is shaped like a narrow-banded, circular collar having an extended bib. The collar has a blood-shielding, light-weight, multi-layered cloth. The outer layer of the multi-layered cloth is a soft, blood-repellent material. The innermost layer of material wicks moisture away from the wearer's neck. A spongy layer in the center of the collar provides softness and comfort to the wearer. This spongy layer also assists in maintaining the shape of the collar. The collar is adjustable to many different neck sizes from between 13 and 19 inches, approximately.

9 Claims, 1 Drawing Sheet

NECK-PROTECTING GARMENT FOR SURGEONS AND OPERATING ROOM PERSONNEL

Field of the Invention

The present invention relates to hospital garments for surgeons and support staff, and, more particularly, to an adjustable, neck-protecting surgical garment that maintains its shape, is blood- and fluid-repellent, and comfortable to wear.

BACKGROUND OF THE INVENTION

In the past, surgical-type garments were designed primarily to maintain antiseptic and sterile conditions in operating and emergency rooms. The patient's health was paramount. Surgical gowns and smocks were intended to protect the patient from germs of the surgeon and his or her clothing, but were not overly protective of all parts of the body of the wearer from blood splatter. These smocks normally extended from below the knee to just below the neck of operating personnel. Cloth hats were worn to guard against hair and dandruff fallout.

With the advent of HIV, hepatitis, and other blood contact transmission-type diseases, the focus of garment design is shifting. It is now very important, not only to protect the patient, but also to protect the surgeon and other operating personnel from coming into contact with the blood of the patient.

Despite the greater awareness on the part of surgeons and support staff, blood contact is all too common. It is, therefore, necessary to design hospital garments with greater protection to guard against inadvertent blood and fluid contact.

The present invention reflects the discovery that present hospital garments are not fully protective of hospital personnel. The neck area, particularly, has never been covered by these garments, unless one was wearing a "space" suit of the type shown in U.S. Pat. No. 5,005,216, issued to Blackburn et al, on Apr. 9, 1991, for SELF-VENTILATING PROTECTIVE GARMENT. Typical surgical gowns leave the neck completely open, and subject to inadvertent blood splattering.

The present invention is a neck-protecting garment to be used in conjunction with surgical gowns and smocks. The protector is shaped like a collar having an extended bib, and comprises a blood-shielding, light-weight, multi-layered cloth. The outer layer of the collar features a soft, repellent material, such as is used in operating room gowns. The innermost layers is a polypropylene liner, which wicks moisture away from the neck. A spongy foam layer in the collar provides softness and comfort to the wearer. This spongy layer assists in maintaining the shape of the collar. An intermediate layer, of interface material, disposed between the spongy layer and the outer layer, acts as an interface and provides added support and shape-definition, similar to the backing found in dress shirts. The collar is adjustable to many different neck sizes, to accommodate different surgeons, from between approximately 13 and 19 inches. The adjustability is accomplished by mating VELCRO® strips that are respectively sewn into the neck protector at distal ends thereof.

The neck protector of the current invention is designed to be a supplemental piece of clothing for the normal or typical surgical gown, so that it can be optionally worn by hospital and surgical staff. It is also contemplated, however, that it can be combined as one piece with a surgical gown or smock during the fabrication stage.

DISCUSSION OF RELATED ART

In U.S. Pat. No. 4,387,471, issued to Hsu et al, on Jun. 14, 1983, for RETAINER FOR SURGEON'S EYE GLASSES, a hood-shaped protective garment is shown that extends downwardly over the neck area. The present neck protecting garment, however, is not necessarily part of a hood. It is designed to have definition around the neck (i.e., it is shaped as a snugly-fitting collar). The current neck protecting collar of the invention is a stand-alone piece of apparel that need not function in the capacity of protecting eye glasses.

In U.S. Pat. No. 4,686,710, issued to Marston et al, on Aug. 18, 1987, for SPORTS NECK PROTECTOR, a collar and bib type protector is shown, similar in shape to the current invention. This neck protecting device has a different purpose and agenda, however, from that of the invention. The main purpose of this protector is to prevent injury to the wearer by means of inadvertent body contact with another player or sharp and flying objects, such as skate blades and hockey pucks. By contrast, the present invention is lighter, more flexible; its primary purpose is to shield against blood contact.

SUMMARY OF THE INVENTION

In accordance with the present invention, there is provided a blood-repellent neck protector for hospital, surgical, emergency room, and radiology department personnel. The protector is shaped like a narrow-banded, circular collar having an extended bib. The collar comprises a blood-shielding, light-weight, multi-layered cloth. The outer layer of the multi-layered cloth is a soft, blood-repellent material, such as is commonly found in operating room apparel (e.g., Barrier™ material produced by the Johnson & Johnson Medical, Inc.). The blood-repellent cloth is comfortable against the skin, and wicks moisture away from the neck. A spongy layer in the center of the collar provides softness and comfort to the wearer. This spongy layer also assists in maintaining the shape of the collar. An intermediate layer can be disposed between the spongy layer and the outer layer to act as an interface and provide added support and shape-keeping definition, similar to the backing found in dress shirts. The collar is adjustable to many different neck sizes between approximately 13 and 19 inches. The adjustability is accomplished by mating VELCRO® strips that are respectively sewn into the neck protector's uppermost edge at distal ends thereof.

It is an object of this invention to provide a neck protector for use in hospitals, operating rooms, emergency rooms, and radiology departments.

It is another object of the invention to provide a blood-repellent, neck-protective garment for hospital personnel.

BRIEF DESCRIPTION OF THE DRAWINGS

A complete understanding of the present invention may be obtained by reference to the accompanying drawings, when considered in conjunction with the subsequent detailed description, in which.

For purposes of clarity and brevity, like elements and components will bear the same numerical designation throughout the FIGURES.

DESCRIPTION OF THE PREFERRED EMBODIMENT

The present invention features a blood-repellent neck protector for hospital, surgical, emergency room, and radiology department personnel. The protector is shaped like a narrow-banded, circular collar having an extended bib. The collar comprises a blood-shielding, light-weight, multi-layered cloth.

Figure 1:
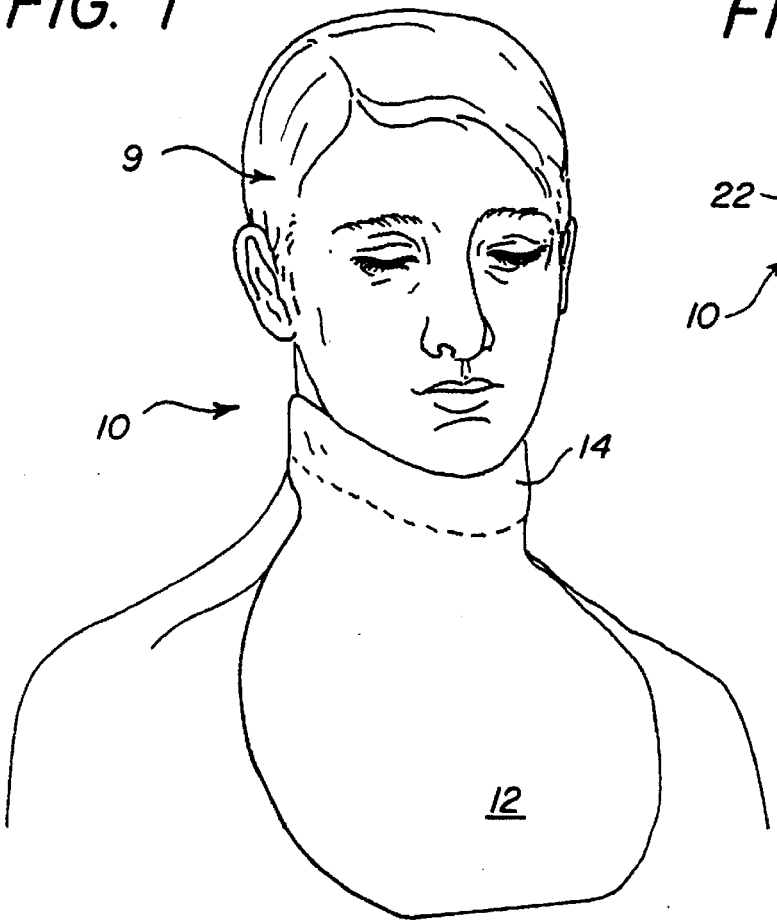
FIG. 1 illustrates a perspective, in situ view of the protective neck garment of this invention.

Now referring to FIG. 1, the neck garment 10 of this invention is shown in situ, as worn about the neck of a hospital person (e.g., surgeon, nurse, surgical assistant, etc.) 9. The neck garment 10 comprises two sections that are integrated into one cloth piece. The two sections comprise a collar section 11 and a bib section 12, as shown. The neck garment 10 is to be worn in combination with normal surgical and emergency room apparel, not shown. It will be observed that the neck garment 10 completely surrounds the neck and the upper chest region of the hospital person 9.

Figure 2:
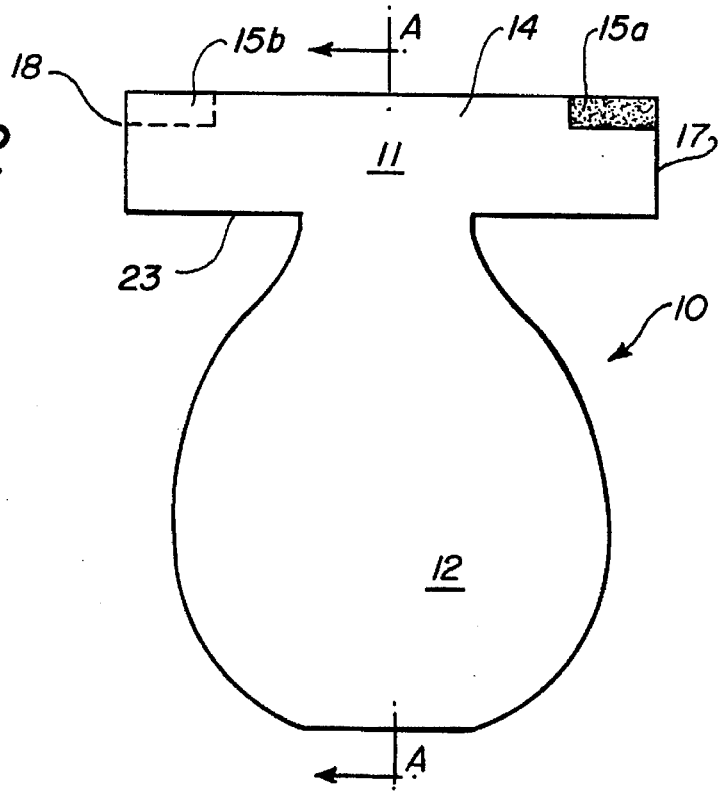
FIG. 2 depicts a plan view of the protective neck garment shown in FIG. 1.

Referring now also to FIG. 2, the neck garment 10 is illustrated in plan view. The collar section 11 is shown in its unattached configuration. The collar section 11 comprises an elongated piece of cloth 14, having mating VELCRO® strips 15*a* and 15*b*, respectively sewn on opposite sides of the collar cloth body 14, at the uppermost distal ends 17 and 18. This shape allows the collar cloth body 14 to be wrapped around the neck in circular fashion, as shown in FIG. 1.

As aforementioned, the bib section 12 extends from the collar section 11. The elongated collar cloth body 14 is designed to be wrapped around the neck of the hospital person 9, as shown in FIG. 1. The mating, respective VELCRO® strips 15*a* and 15*b*, each being approximately 1 inch high and approximately 3.5 inches wide, allow the collar cloth body 14 to be adjusted to various neck sizes of between 13 and 19 inches, approximately, depending upon the amount of overlap of the strips 15*a* and 15*b*. The position of the VELCRO® strips at the uppermost border of the collar section 11 helps prevent the top of the collar from sliding downwardly. The strips 15*a* and 15*b* also allow the hospital person 9 to wrap the collar section 11 tightly or loosely about his or her neck, as preferred.

Figure 3:
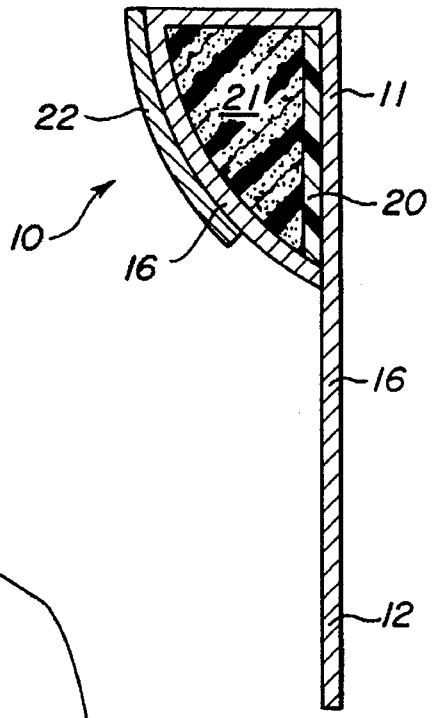
FIG. 3 shows a sectional view taken along lines A—A, of the protective neck garment illustrated in FIG. 2.

Referring now also to FIG. 3, a sectional view of the neck garment 10 is depicted in order to show the construction thereof. The neck garment 10 comprises an outer layer of cloth 16 forming sections 11 and 12, respectively. Outer layer of cloth 16 is wrapped upwardly, over the collar also to form an inner, double protective layer 16. Thus, one layer 16 is used both as the outer and the inner layer of the structure. These layers are preferably made of blood-repellent material, such as the BARRIER™ line of products (Extra and Ultra) manufactured by Johnson & Johnson Medical, Inc.

The collar cloth body 14 may also comprise an intermediate, interface layer 20, a sponge-like layer 21, and an inner wicking layer 22, such as polypropylene.

The optional intermediate, interface layer 20 is similar to the cloth backings found in dress shirts. Layer 20 has the purpose of giving the collar section 14 structural integrity and stiffness, so that the collar section 11 will maintain its shape. Materials useful for the intermediate layer 20 could comprise any commercially available interface material.

The optional sponge-like layer 21 is much thicker than the other layers, and is designed to provide wearer comfort. The sponge-like layer 21 can comprise soft foam materials such as soft urethanes.

The optional inner wicking layer 22 can comprise comfortable, breathable material to help discourage growth of bacteria in moist skin.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. For example, a neck protector without the sponge-like layer 21 and without the intermediate layer 20 and without the inner wicking layer 22 can be constructed, but would lack the structural integrity and the breathability functions of the preferred embodiment.

Having thus described the invention, what is desired to be protected by Letters Patent is presented in the subsequently appended claims.

What is claimed is:

1. A blood-repellent neck protector for hospital, surgical and emergency-room personnel that forms a collar having an extended bib, said neck protector comprising:

a blood-repellent, narrow-banded, elongated collar section having fastening means disposed on distal ends thereof for wrapping said collar section about a neck of a hospital person, said elongated collar section comprising, in cross-section, an outer and an inner layer, containing therebetween a sponge-like layer to provide wearer comfort to said hospital person and including a stiffening layer to maintain a collar shape, said stiffening layer being disposed between said sponge-like layer and said outer layer; and a bib section integral with said elongated collar section and extending downwardly therefrom, said elongated collar section and said bib section to be worn about the neck of said hospital person for protecting said hospital person against blood splatter.

2. The blood-repellent neck protector in accordance with claim 1, wherein said bib section and said inner and outer layers comprise a single piece of material.

3. The blood-repellent neck protector in accordance with claim 1, wherein said elongated collar section further comprises material disposed proximate said inner layer for wicking perspiration from the neck of said hospital person.

4. The blood-repellent neck protector in accordance with claim 3, wherein material for wicking comprises polypropylene.

5. The blood-repellent neck protector in accordance with claim 1, wherein said fastening means comprises mating strips of material comprising hook and loop fasteners disposed at the uppermost portions of said collar.

6. A blood-repellent neck protector for hospital, surgical and emergency-room personnel that forms a perspiration-wicking collar having an extended bib, said neck protector comprising:

a blood-repellent, perspiration-wicking, elongated collar section having fastening means disposed on distal, uppermost ends thereof for wrapping said collar section about a neck of a hospital person in circular fashion, said elongated collar section comprising, in cross-section, an outer and an inner layer, containing therebetween a sponge-like layer to provide wearer comfort to said hospital person; and a bib section integral with said elongated collar section and extending downwardly therefrom, said elongated collar section and said bib section to be worn about the neck of said hospital person for protecting said hospital person against blood splatter, said bib section being further defined as a flat, flexible section that widens from a point integral with said blood-repellent, perspiration-wicking, elongated collar section, thereby forming a peninsula-like extension therefrom, and wherein said bib section and said inner and outer layers of said blood-repellent, perspiration-wicking, elongated collar section comprise breathable, blood-repellent material.

7. The blood-repellent neck protector in accordance with claim 6, wherein said bib section and said inner and outer layers comprise a single piece of material.

8. The blood-repellent neck protector in accordance with claim 6, wherein said sponge-like layer comprises a urethane foam.

9. A blood-repellent neck protector for hospital, surgical and emergency-room personnel that forms a collar having an extended bib, said neck protector comprising:

a blood-repellent, narrow-banded, elongated collar section having fastening means disposed on distal ends thereof, for wrapping said collar section about a neck of a hospital person and for providing adjustability about said neck of said hospital person, said elongated collar section comprising, in cross-section, an outer and an inner layer, containing therebetween a sponge-like layer to provide wearer comfort to said hospital person; and a bib section integral with said elongated collar section and extending downwardly therefrom, said elongated collar section and said bib section to be worn about the neck of said hospital person for protecting said hospital person against blood splatter, said bib section being further defined as a flat, flexible section of blood-repellent material that widens from a point integral with said blood-repellent, elongated collar section, thereby forming a peninsula-like extension therefrom that covers a substantial area of a chest portion of said hospital person.

* * * * *